US007621724B2

(12) United States Patent
Yaguchi et al.

(10) Patent No.: US 7,621,724 B2
(45) Date of Patent: Nov. 24, 2009

(54) STATOR FOR SOLENOID PUMPS

(75) Inventors: Fumihiro Yaguchi, Nagano (JP); Hiroaki Usui, Nagano (JP); Masaharu Tashima, Nagano (JP)

(73) Assignee: Shinano Kenshi Kabushiki Kaisha, Nagano (JP)

( * ) Notice: Subject to any disclaimer, the term of this patent is extended or adjusted under 35 U.S.C. 154(b) by 522 days.

(21) Appl. No.: 10/566,469

(22) PCT Filed: Aug. 2, 2004

(86) PCT No.: PCT/JP2004/011047

§ 371 (c)(1),
(2), (4) Date: Jan. 31, 2006

(87) PCT Pub. No.: WO2005/012726

PCT Pub. Date: Feb. 10, 2005

(65) Prior Publication Data

US 2006/0239835 A1 Oct. 26, 2006

(30) Foreign Application Priority Data

Aug. 1, 2003 (JP) ..... 2003-285243

(51) Int. Cl.
*F04B 35/04* (2006.01)

(52) U.S. Cl. ..... 417/418; 417/410.1

(58) Field of Classification Search ..... 417/321, 417/410.1, 322, 353, 352, 418
See application file for complete search history.

(56) References Cited

U.S. PATENT DOCUMENTS

| | | | | | |
|---|---|---|---|---|---|
| 4,965,864 | A * | 10/1990 | Roth et al. | ..... | 318/135 |
| 5,302,872 | A * | 4/1994 | Ohki et al. | ..... | 310/12 |
| 6,568,921 | B2 * | 5/2003 | Dittrich | ..... | 417/312 |
| 6,783,335 | B2 * | 8/2004 | Chang | ..... | 417/417 |
| 6,971,861 | B2 * | 12/2005 | Black et al. | ..... | 417/440 |

FOREIGN PATENT DOCUMENTS

| | | |
|---|---|---|
| JP | 54-85404 A | 6/1979 |
| JP | 85404/1979 | 6/1979 |
| JP | 58-28468 A | 6/1983 |
| JP | 58-28468 Y2 | 6/1983 |
| JP | 4-13431 A | 3/1992 |
| JP | 4-13431 Y2 | 3/1992 |
| JP | 2004-124724 A | 4/2004 |

* cited by examiner

*Primary Examiner*—Michael Cuff
*Assistant Examiner*—Vikansha S Dwivedi
(74) *Attorney, Agent, or Firm*—Birch, Stewart, Kolasch & Birch, LLP

(57) ABSTRACT

The stator for an electromagnetic pump is designed to improve output efficiency of the pump by decreasing leakage flux. An air-core electromagnetic coil (50*a*, 50*b*) is fitted around periphery of a cylinder, and axial end faces of an electromagnetic coil (50*a*, 50*b*) are provided with yokes (26*a*, 26*b*, 26*c*) made of a magnetic material.

1 Claim, 3 Drawing Sheets

STATOR FOR SOLENOID PUMPS

FIELD OF TECHNOLOGY

The present invention relates to a stator for an electromagnetic pump, more precisely relates to a compact stator for an electromagnetic pump used for sending a fluid, e.g., gas, liquid.

BACKGROUND TECHNOLOGY

The inventors of the present invention invented a small and thin electromagnetic pump, wherein a moving member made of a magnetic material is reciprocally moved in a cylinder of a stator, pump chambers are respectively formed between both end faces of the cylinder and both side faces of the moving member extended in the moving direction thereof, electromagnetic coils are fitted around periphery of the cylinder, a fluid is introduced into one of the pump chambers from outside via a first valve and discharged outside via a second valve by applying electricity to the electromagnetic coils, and the fluid is introduced into and discharged from the other pump chamber by the same manner (see Patent Document 1).

FIG. 7 shows partial sectional views of the moving member 101 and the stator 102. Note that, the cylinder section between the moving member 101 and the stator 102 is omitted. Magnetic fluxes generated from an N-pole of a magnet 103 of the moving member 101 form a magnetic circuit to an S-pole of the magnet 103 via an inner yoke 104*a*, an outer yoke 105 and an inner yoke 104*b*. By applying electricity to electromagnetic coils 106*a* and 106*b*, an electromagnetic force is applied to the electromagnetic coils 106*a* and 106*b* from the magnetic field, but the electromagnetic coils 106*a* and 106*b* are fixed to the stator 101 so that the moving member 102 is moved in the axial direction (in the vertical direction in FIG. 7) as a counteraction.

Patent Document 1; Japanese Pat. App. 20002-286188

DISCLOSURE OF THE INVENTION

Problems to be Solved by the Invention

In the electromagnetic pump shown in FIG. 7, a distance between the inner yokes 104*a* and 104*b* of the moving member 101 and the outer yoke 105 of the stator 102 is long, so magnetic fluxes generated by the magnet 103 of the moving member 101 are apt to leak outside until the magnetic fluxes reach the outer yoke 105; the electromagnetic force, which works to the moving member 101 by applying electricity to the electromagnetic coils 106*a* and 106*b*, cannot be effectively used. Therefore, a thrust force working to the moving member 101 must be small, so that efficiency of the pump must be low. To reduce leakage fluxes and improve the efficiency, the stator 102 must be large so the electromagnetic pump cannot be small in size. If a movable range of the moving member 101 is shifted from a center part of the cylinder to an upper part or a lower part, the moving member 101 directly strikes upper and lower frames, which respectively close end faces of the cylinder, so that noises are generated.

The present invention has invented to solve the above described problems, and an object is to provide a stator of an electromagnetic pump, which is capable of improving output efficiency of the pump by decreasing leakage flux, decreasing noises during operation and stabilizing pump characteristics.

To achieve the object, the present invention has following structures.

A stator for an electromagnetic pump comprises: a cylinder whose both end faces are respectively closed by a pair of frames; a movable member having a magnetic body, the movable member being accommodated in the cylinder and capable of reciprocally moving in the axial direction thereof; pump chambers being respectively formed between inner faces of the frames and both side faces of the moving member extended in the moving direction thereof; and an air-core electromagnetic coil being fitted around periphery of the cylinder, characterized in that axial end faces of the electromagnetic coil are provided with yokes made of a magnetic material.

In the stator, a plurality of the air-core electromagnetic coils may be fitted around the periphery of the cylinder, and the axial end faces of each of the electromagnetic coils may be provided with the yokes made of the magnetic material.

In the stator, a plurality of the air-core electromagnetic coils may be fitted around the periphery of the cylinder, and a spacer made of a nonmagnetic material or an air space may be provided between the yokes of the adjacent electromagnetic coils.

In the stator, a plurality of the air-core electromagnetic coils may be fitted around the periphery of the cylinder, and the yokes of each of the electromagnetic coils may be extended toward an inner face of each of the electromagnetic coils, which faces a magnetic flux working surface of the moving member.

Effects of the Invention

By using the stator of the present invention, magnetic fluxes generated by the moving member run through the magnetic yokes, which are provided to the axial end faces of the electromagnetic coil, so that number of the magnetic fluxes returned to the moving member can be increased; leakage fluxes can be reduces, number of magnetic fluxes, which are interlinked by applying electricity to the electro magnetic coil, can be increased, and output efficiency of the pump can be improved without using a large stator. Especially, by fitting a plurality of the electromagnetic coils around the periphery of the cylinder and providing the magnetic yokes to the axial end faces of each electromagnetic coil, number of magnetic fluxes, which are interlinked by applying electricity to the electro magnetic coils, can be securely increased, and the output efficiency of the pump can be further improved.

By providing the nonmagnetic spacer or the air space between the yokes of the adjacent electromagnetic coils, or extending the yokes of each electromagnetic coil toward the inner face of each electromagnetic coil, which faces the magnetic flux working surface of the moving member, the moving member can be reciprocally moved in a moving range which is located a center part of the axial direction of the cylinder, so that the moving member does not strike the frames, noises can be reduced and pump characteristics can be stabilized.

PREFERRED EMBODIMENTS OF THE INVENTION

Figure 1:
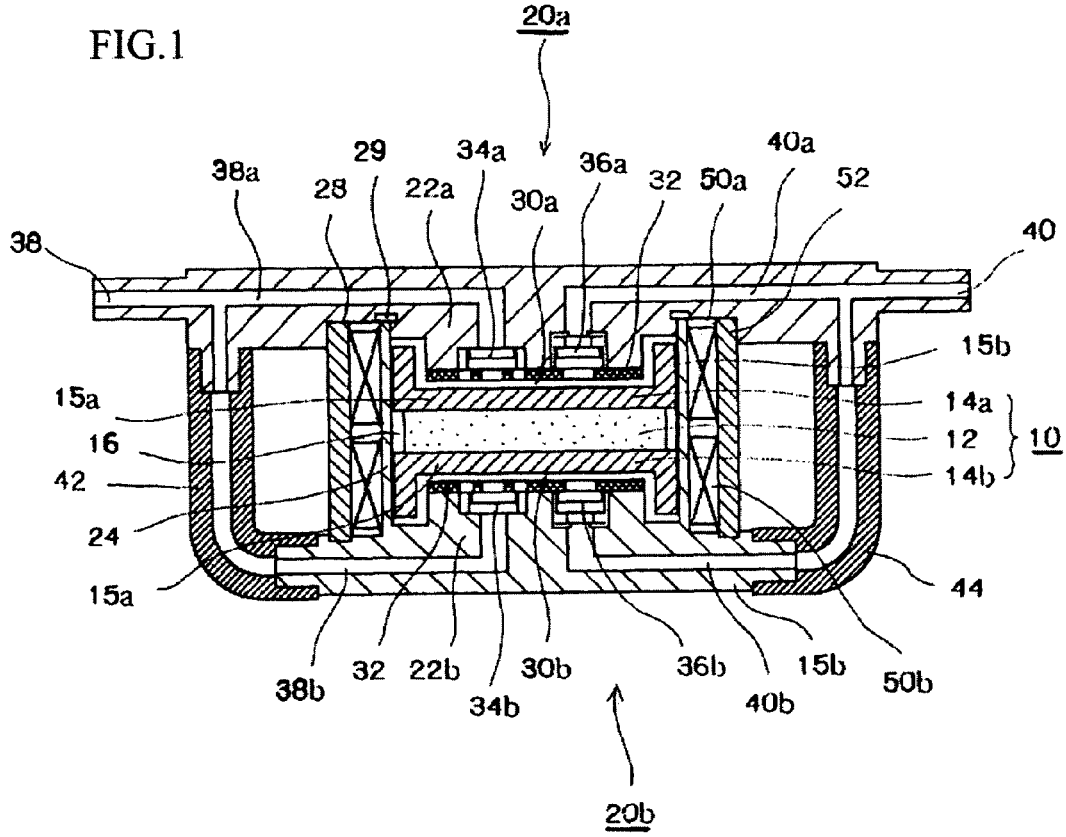
FIG. 1 is a sectional view of a whole structure of an electromagnetic pump relating to the present invention.

The preferred embodiments of the stator of the present invention will be explained with reference to the accompanying drawings. FIG. 1 is a sectional view of a whole structure of an electromagnetic pump relating to the present invention.

In the electromagnetic pump of the present embodiment, a moving member having a magnet (permanent magnet) is accommodated in a cylinder and capable of sliding in the axial direction of the cylinder, a plurality of electromagnetic coils are provided around the periphery of the cylinder so as to apply magnetic forces generated by the electromagnetic coils to the moving member, thereby the moving member is reciprocally moved to perform pumping action.

Firstly, a whole structure of the electromagnetic pump will be explained with reference to FIG. 1. A moving member 10 is accommodated in a closed cylinder and capable of reciprocally moving in the axial direction of the cylinder. The moving member 10 is constituted by a disk-shaped magnet 12 and a pair of inner yokes 14*a* and 14*b*, which sandwich the magnet 12 in the thickness direction. The magnet 12 is a permanent magnet magnetized in the thickness direction (the vertical direction in FIG. 1), and one of surfaces of the magnet is an N-pole, the other surface is an S-pole. The inner yokes 14*a* and 14*b* are made of a magnetic material, and each of the inner yokes 14*a* and 14*b* comprises a plate section 15*a*, whose diameter is slightly greater than that of the magnet 12, and a flange section 15*b*, which is vertically extended from an edge of the plate section 15*a* like a short cylinder. Outer circumferential faces of the flange sections 15*b* act as magnetic flux working surfaces of the moving member 10, and magnetic fluxes generated by the magnet 12 work therefrom.

A closing member 16, which is made of a nonmagnetic material, e.g., plastic, covers an outer circumferential face of the magnet 12.

The closing member 16 covers the magnet 12 so as to prevent the magnet 12 from exposing and rusting and integrates the magnet 12 with the inner yokes 14*a* and 14*b*. The closing member 16 fills an outer periphery of the magnet 12, which is sandwiched by the inner yokes 14*a* and 14*b*, but an outer diameter of the closing member 16 is slightly shorter than those of the inner yokes 14*a* and 14*b*. By employing that closing member 16, the closing member 16 does not contact a grinding blade so that outer circumferential faces of the inner yokes 14*a* and 14*b* can be finished without damaging the grinding blade; and reduction of a space between the moving member 10 and the cylinder, which is caused by thermal expansion of the closing member 16 when the pump is used at high temperature, can be prevented even if a thermal expansion coefficient of the closing member 16 is greater than those of the inner yokes 14*a* and 14*b*, so that the pump can be stably operated.

Next, a stator of the electromagnetic pump will be explained with reference to FIG. 1. An upper frame 20*a* and a lower frame 20*b*, which are made of a nonmagnetic material, constitute the cylinder, and the moving member 10 is movably accommodated in the cylinder as described above. In the present embodiment, a cylindrical section 24 is integrated with a frame body 22*b* of the lower frame 20*b*. An upper end of the cylindrical section 24 is fitted in a groove 28, which is formed in a frame body 22*a* of the upper frame 20*a*, so that the cylinder, whose axial end faces are closed by the frames 20*a* and 20*b*, can be formed. A sealing member 29, which is provided in the groove 28, contacts the upper end of the cylindrical section 24, so the inner space of the cylinder can be tightly sealed by making the upper end of the cylindrical section 24 contacts the sealing member 29. Note that, the cylindrical section 24 may be extended from the upper frame 20*a* and fitted with the lower frame 20*b*. Further, the cylindrical section 24 may be separated from the lower frame 20*b* or the upper frame 20*a*.

As described above, the axial end faces of the cylinder are closed by the frames 20*a* and 20*b*, and pump chambers 30*a* and 30*b* are respectively formed between inner faces of the frames 20*a* and 20*b* and both side faces of the moving member 10 extended in the moving direction thereof. The pump chambers 30*a* and 30*b* respectively correspond to spaces formed between both surfaces of the moving member 10 and the frame bodies 22*a* and 22*b* of the frames 20*a* and 20*b*. The moving member 10 slides on the inner face of the cylinder with air-tightly or liquid-tightly sealing the cylindrical section 24. To smoothly slide the moving member 10, the outer circumferential face of the inner yokes 14*a* and 14*b* are coated with a lubricative and rust-resistant coating agent. Further, means for preventing rotation of the moving member 10 may be provided.

Dampers 32 are provided to the end faces (inner faces) of the frame bodies 22*a* and 22*b*. The dampers 32 absorb shocks when the inner yokes 14*a* and 14*b* contact the end faces of the frame bodies 22*a* and 22*b* at end positions of a movable range of the moving member 10. Note that, the dampers 32 may be provided to end faces of the inner yokes 14*a* and 14*b*, which contact the frame bodies 22*a* and 22*b*, instead of the end faces of the frame bodies 22*a* and 22*b*.

An inlet valve 34*a* and an outlet valve 36*a* are provided in the frame body 22*a* of the upper frame 20*a* and connected to the pump chamber 30*a*. An inlet valve 34*b* and an outlet valve 36*b* are provided in the frame body 22*b* of the lower frame 20*b* and connected to the pump chamber 30*b*.

Inlet paths 38*a* and 38*b* are respectively formed in the frames 20*a* and 20*b* and connected to the valves 34*a* and 34*b*. Outlet paths 40*a* and 40*b* are respectively formed in the frames 20*a* and 20*b* and connected to the valves 36*a* and 36*b*. The path 38*a* of the upper frame 20*a* is connected to the path 38*b* of the lower frame 20*b* via a connection tube 42; the path 40*a* of the upper frame 20*a* is connected to the path 40*b* of the lower frame 20*b* via a connection tube 44. With this structure, the inlet paths and the outlet paths of the frames 20*a* and 20*b* are respectively connected to one inlet port 38 and one outlet port 40.

In FIG. 1, air-core electromagnetic coils 50*a* and 50*b* are fitted around the periphery of the cylinder. The electromagnetic coils 50*a* and 50*b* are slightly separated in the axial direction of the cylinder and symmetrically arranged with respect to the axial line of the cylinder. Axial lengths of the electromagnetic coils 50*a* and 50*b* are longer than moving strokes of the flange sections 15*b* of the inner yokes 14*a* and 14*b*. The electromagnetic coils 50*a* and 50*b* are wound in the opposite directions, and electricity is supplied from one electric source so that electric currents run in the opposite directions. Since the electromagnetic coils 50*a* and 50*b* are wound in the opposite directions, forces working to the electric currents running through the electromagnetic coils 50*a* and 50*b*, which interlink with the magnetic fluxes of the magnet 12, are combined, and the combined force works to the moving member 10 as a counter force or a thrust force.

A outer yoke 52 encloses the electromagnetic coils 50*a* and 50*b*. The outer yoke 52 is made of a magnetic material so as to increase number of magnetic fluxes interlinking the electromagnetic coils 50*a* and 50*b* and effectively work an electromagnetic force to the moving member 10. Since the flange sections 15*b* are extended from the edges of the inner yokes 14*a* and 14*b*, which constitute the moving member 10, in the axial direction, magnetic resistance of a magnetic circuit, which is formed from the magnet 12 to the outer yoke 52 via the inner yokes 14*a* and 14*b*, can be reduced. With this structure, total number of magnetic fluxes from the moving member 10 can be increased (the magnetic circuit for passing magnetic fluxes can be securely formed), magnetic fluxes generated by the magnet 12 can be interlinked with the electric currents running through the electromagnetic coils 50*a* and 50*b* at a right angle so that a thrust force for moving the moving member 10 in the axial direction can be effectively generated. Further, mass of the moving member 10 is lower with respect to the thrust force, so that fast response can be performed and flow volume can be increased.

When the frames 20*a* and 20*b* are fitted together, the electromagnetic coils 50*a* and 50*b* and the outer yoke 52 can be coaxially arranged by fitting the outer yoke 52 in the grooves 28 of the frames 20*a* and 20*b*.

When an alternate current is supplied to the electromagnetic coils 50*a* and 50*b*, the moving member 10 is reciprocally moved (in the vertical direction) by electromagnetic forces generated by the electromagnetic coils 50*a* and 50*b*. Since the electromagnetic forces generated by the electromagnetic coils 50*a* and 50*b* move the moving member 10 in one direction and the opposite direction according to the directions of the electric current running through the electromagnetic coils 50*a* and 50*b*, the moving member 10 can be reciprocally moved with optional stroke by controlling time of supplying electricity to the electromagnetic coils 50*a* and 50*b* and the directions of the electric current running therethrough with a control section, not shown. When the moving member 10 contacts the inner faces of the frame bodies 22*a* and 22*b*, the shocks can be absorbed by the dampers 32.

Note that, a sensor for detecting the position of the moving member 10 in the cylinder may be provided so as to control the reciprocative movement of the moving member 10 on the basis of detecting signals of the sensor. In other cases, the positions of the moving member 10 may be detected by a magnetic sensor, which is provided outside of the cylinder, or a pressure sensor, which is provided to the damper 32 so as to detect the moving member 10 contacting the damper 32. In the electromagnetic pump of the present embodiment, a moving stroke of the moving member 10 is relatively short, but the pump chambers 30*a* and 30*b* are relatively broad; fixed flow volume can be secured by reciprocally moving the moving member 10 at high speed.

The pumping action of the electromagnetic pump is performed by reciprocally moving the moving member 10 by the electromagnetic coils 50*a* and 50*b*, so that a fluid is alternately introduced into and discharged from the pump chambers 30*a* and 30*b*. Namely, in FIG. 1, when the moving member 10 is moved downward, the fluid is introduced into the pump chamber 30*a*; simultaneously, the fluid is discharged from the pump chamber 30*b*. On the other hand, when the moving member 10 is moved upward, the fluid is discharged from the pump chamber 30*a*; simultaneously, the fluid is introduced into the pump chamber 30*b*. Even if the moving member 10 is moved in any directions, the fluid is introduced and discharged, so that pulsation of the fluid can be restricted and the fluid can be sent efficiently.

In the electromagnetic pump of the present embodiment, the moving member 10 includes the inner yokes 14*a* and 14*b* having the flange sections 15*b*, and the inlet valves 34*a* and 34*b* and the outlet valves 36*a* and 36*b* are located close to the end faces of the moving member 10, so that the thin and compact pump can be produced. For example, a height of the electromagnetic pump is about 15 mm, and a width thereof is about 20 mm.

The electromagnetic pump of the present embodiment cab be used for sending any kinds of fluid, e.g., gas, water, antifreeze liquid. In case of using the pump as a fluid pump, if the pump has one moving member 10 and its sending pressure is low, a plurality of the moving members 10, each of which is constituted by the magnet 12 and the inner yokes 14*a* and 14*b*, may be used as a coupled moving member. By coupling a plurality of the moving members, a greater thrust force can be gained so that the electromagnetic pump having a prescribed sending pressure can be produced.

EXAMPLE 1

Figure 2:
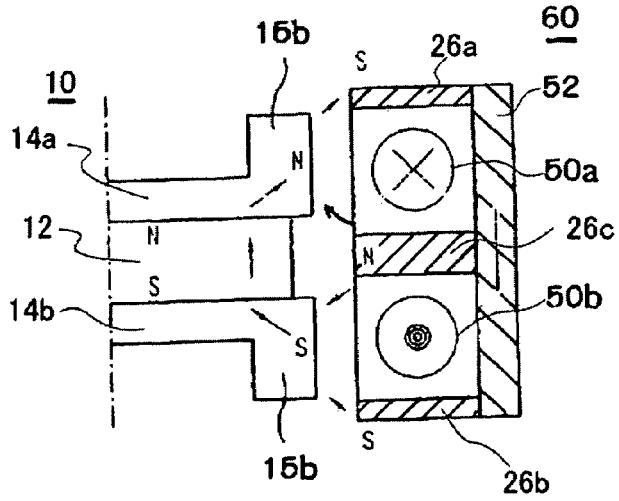
FIG. 2 is a partial sectional view of Example 1 of a stator for the electromagnetic pump.

A unique structure of a stator 60 for the electromagnetic pump will be explained with reference to FIGS. 2-6. In the drawings, the cylinder section 24, the valves connected to the pump chambers and the flow paths are omitted. In FIG. 2, yokes 26*a*, 26*b* and 26*c* made of a magnetic material are integrated with axial end faces of the electromagnetic coils 50*a* ad 50*b*. For example, the yokes 26*a* and 26*c* are provided to the end faces of the electromagnetic coil 50*a*; the yokes 26*b* and 26*c* are provided to the end faces of the electromagnetic coil 50*b*. The yoke 26*c* provided between the electromagnetic coils 50*a* ad 50*b* is a common yoke.

If the electric current runs through the electromagnetic coils 50*a* ad 50*b* in the direction shown in FIG. 2, a right-handed magnetic field is generated around the coils, a moving member 10 side of the yoke 26*c* is magnetized as the N-pole, moving member 10 sides of the yokes 26*a* and 26*b* are magnetized as the S-pole, a downward electromagnetic force works to the stator 60, and an upward thrust force is applied to the moving member 10 as a counteraction. If the electric current runs through the electromagnetic coils 50*a* ad 50*b* in the direction opposite to the direction shown in FIG. 2, a downward thrust force is applied to the moving member 10. By repeating the above described actions, the pumping action can be performed. Magnetic fluxes passing the magnet 12 and the inner yokes 14*a* and 14*b* of the moving member 10 work to the electromagnetic coils 50*a* and 50*b* of the stator 60 via the flange sections 15. At that time, a magnetic circuit is formed in the yoke 26*a*, the outer yoke 52 and the yoke 26*c*, which are located close to the end face of the electromagnetic coil 50*a*, so that leakage fluxes can be reduced and magnetic fluxes can be effectively used. Therefore, the magnetic fluxes, which pass the yokes 26*a*, 26*b* and 26*c* and return to the moving member 10, can be increased, so that number of the magnetic fluxes, which are interlinked by applying electricity to the electromagnetic coils 50*a* and 50*b*, can be securely increased, and the output efficiency of the pump can be improved. Note that, two electromagnetic coils 50*a* and 50*b* are used in the example shown in FIG. 2, but a plurality of the magnets 12 may be provided to the moving member 10 and number of the electromagnetic coils may be further increased.

EXAMPLE 2

Figure 3:
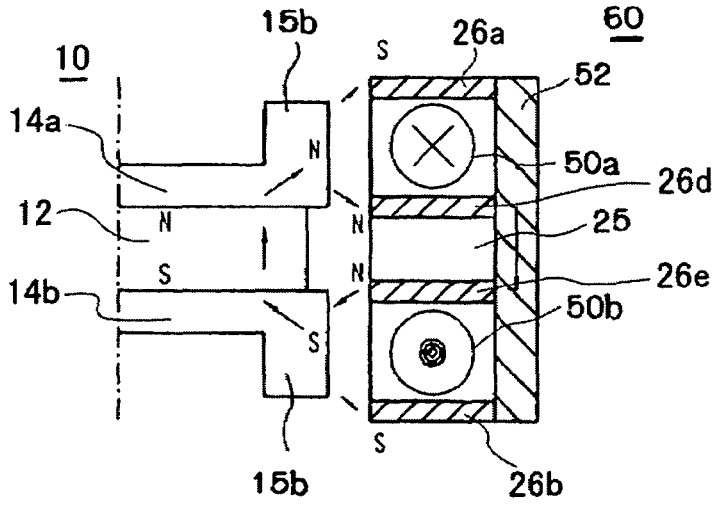
FIG. 3 is a partial sectional view of Example 2 of the stator for the electromagnetic pump.
Figure 4:
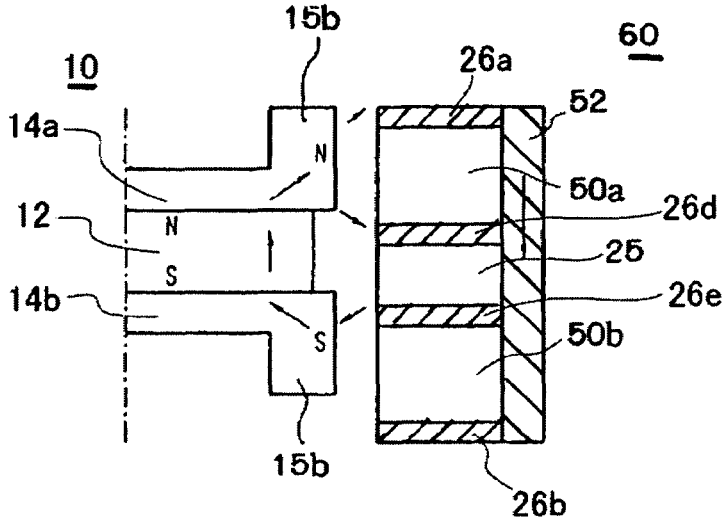
FIG. 4 is an explanation view showing action of a moving member while no electricity is applied.

Another example of the stator 60 for the electromagnetic pump will be explained with reference to FIGS. 3-5. The structural elements shown in FIG. 2 are assigned the same symbols and explanation will be omitted. In FIG. 3, the electromagnetic coils 50*a* and 50*b* are fitted around the periphery of the cylinder as well as the former example. In the present example, two yokes 26*d* and 26*e* are provided between the adjacent end faces of the electromagnetic coils 50*a* and 50*b* instead of the common yoke 26*c*, and a spacer 25 made of a nonmagnetic material is provided between the yokes 26*d* and 26*e*. Note that, a gap (space) may be formed instead of the spacer 25.

If the electric current runs through the electromagnetic coils 50*a* ad 50*b* in the direction shown in FIG. 3, a right-handed magnetic field is generated around the coils, moving member 10 sides of the yokes 26*d* and 26*e* are magnetized as the N-pole, moving member 10 sides of the yokes 26*a* and 26*b* are magnetized as the S-pole, a downward electromagnetic force works to the coils, and an upward thrust force is applied to the moving member 10 as a counteraction. If the electric current runs through the electromagnetic coils 50*a* ad 50*b* in the direction opposite to the direction shown in FIG. 3, a downward thrust force is applied to the moving member 10. By repeating the above described actions, the pumping action can be performed.

By the spacer 25 (or the space) between the yokes 26*d* and 26*e*, if the moving member 10 is moved upward or downward, in FIG. 3, within the movable range, with no electric current passing through the electromagnetic coils 50*a* and 50*b*, a restoring force for returning the moving member 10 toward the axial center of FIG. 3 is increased, and the moving member does not contact the flames, so that noises can be reduced and stable pump characteristics can be gained.

The reason will be explained with reference to FIGS. 4 and 5. In FIG. 4, the moving member 10 has been moved upward from the state shown in FIG. 3. In the magnetic circuit formed in the moving member 10 and the stator 60, the moving member 10 is drawn in a direction of low magnetic resistance (in a direction for easily passing magnetic fluxes). A great drawing force works between the moving member 10 and the yokes 26*d* and 26*e* by the magnetic circuit formed by the yoke 26*d*, the outer yoke 52 and the yoke 26*e*, so that the restoring force work to the moving member 10 downward (toward the center part of the movable range). Note that, the moving member 10, which has been moved upward, is drawn upward between the yokes 26*a* and 26*e* by the magnetic force generated by the magnetic circuit of the yoke 26*a*, the outer yoke 52 and the yoke 26*e*, but the drawing force toward the yokes 26*d* and 26*e*, which are located on the low magnetic resistance side, is greater so that the moving member is biased toward the center part of the movable range.

Figure 5:
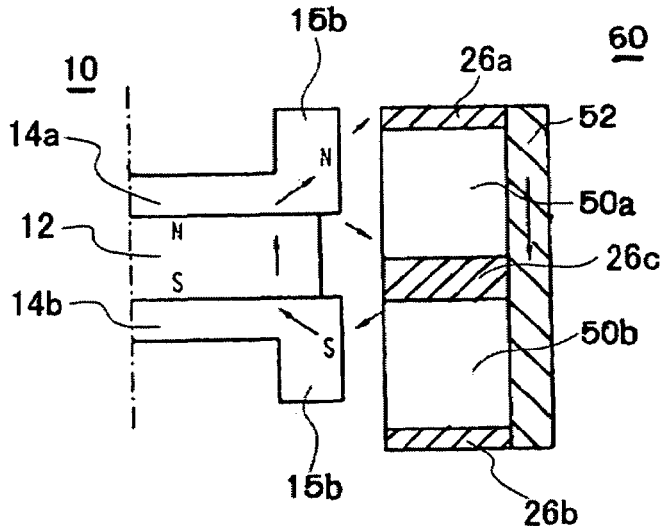
FIG. 5 is an explanation view showing action of the moving member while no electricity is applied.

On the other hand, in FIG. 5, the yoke 26*c* of the stator 60, has no spacer 25 (or no space) as shown in FIG. 2, and the moving member 10 has been slightly moved upward. In FIG. 5, a great drawing force works toward the yoke 26*a* (upward) between the moving member 10 and the yokes 26*a* and 26*c*. Namely, a magnetic circuit is formed from the inner yoke 14*a* to the yoke 14*b* via the yoke 26*a*, the outer yoke 52 and the yoke 26*c*.

Therefore, the upward drawing force is increased with the upward movement of the moving member 10. As shown in FIG. 4, the restoring force working to the moving member 10 can be increased by providing two yokes 26*d* and 26*e*, between which the spacer 25 (or the space) is sandwiched, between the electromagnetic coils 50*a* and 50*b*. With this structure, the moving member 10 can be reciprocally moved without contacting the frame bodies 22*a* and 22*b*, so that noises can be reduced and stable pump characteristics can be gained.

EXAMPLE 3

Figure 6:
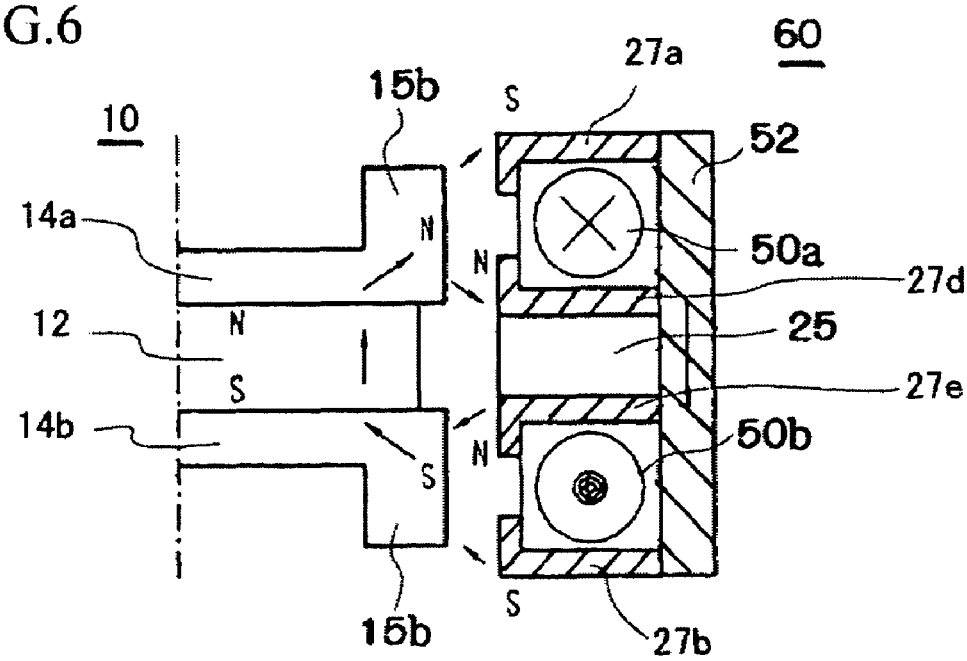
FIG. 6 is a sectional view of Example 3 of the stator for the electromagnetic pump.
Figure 7:
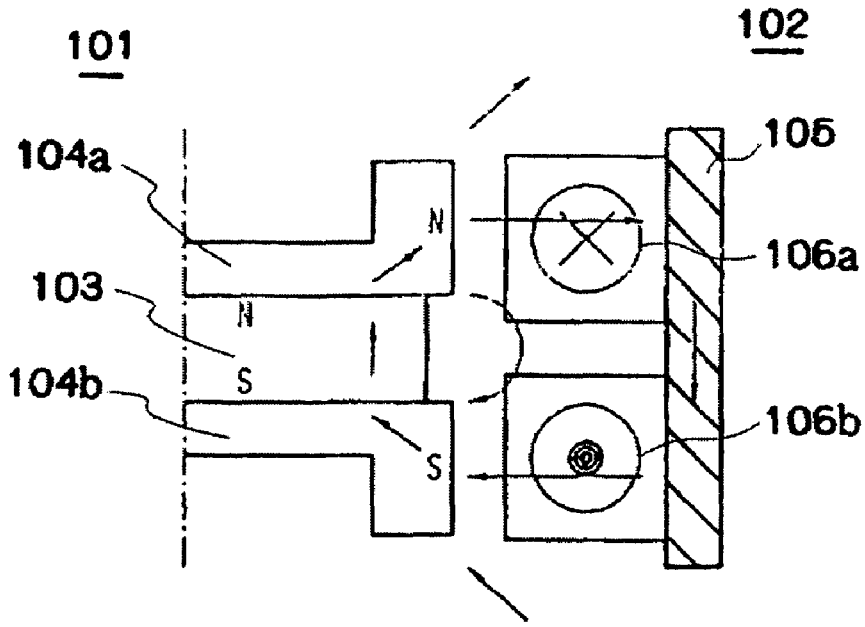
FIG. 7 is a sectional view of the conventional stator for the electromagnetic pump, which is shown so as to explain the problems to be solved by the present invention.

Next, another example of the stator for the electromagnetic pump will be explained with reference to FIG. 6. The structural elements shown in FIG. 2 are assigned the same symbols and explanation will be omitted. In FIG. 6, two yokes 26*d* and 26*e* are provided between the adjacent end faces of the electromagnetic coils 50*a* and 50*b*, and the spacer 25 made of the nonmagnetic material (or the space) is provided between the yokes 26*d* and 26*e* as well as the example shown in FIG. 3. In the present example, yokes 27*a*, 27*d*, 27*e* and 27*b*, which are provided to the end faces of the electromagnetic coils 50*a* and 50*b*, are extended toward the inner faces of the electromagnetic coils 50*a* and 50*b*, which face magnetic flux working surfaces (the flange sections 15*b*) of the moving member 10. With this structure, facing areas of the inner yokes 14*a* and 14*b* (the flange sections 15*b*) and the yokes 27*a*, 27*d*, 27*e* and 27*b* can be broader, so that the magnetic fluxes interlinking with the coils can be increased and the output efficiency of the pump can be improved.

In the above described examples, the flange sections 15*b* are provided to the inner yokes 14*a* and 14*b* of the moving member 10, but the inner yokes 14*a* and 14*b* having no flange sections 15*b* or plate-shaped yokes 14*a* and 14*b* may be employed. In this case, mass of the moving member 10 is increased, so a speed of response is low and reducing the thickness of the pump is limited, but the structure of the pump can be simplified, productivity can be improved and production cost can be reduced.

In the above described examples, the magnet 12 is provided to the moving member 10, the magnet 12 is pinched by the inner yokes 14*a* and 14*b*, but the moving member 10 may have no magnet 12. If the moving member 10 is made of a magnetic material and the moving member 10 is shifted toward one of the electromagnetic coils 50*a* and 50*b*, the electricity is supplied to the one coil so as to move the moving member 10 in the axial direction, then the electricity supplied to the one coil is stopped and the electricity is supplied to the other electromagnetic coil when the moving member 10 reaches a prescribed position so as to move the moving member in the opposite direction. Namely, the moving member 10 can be reciprocally moved in the axial direction by ON-OFF-controlling a pair of the electromagnetic coils.

In the electromagnetic pump shown in FIG. 1, the inlet paths 38*a* and 38*b*, which are respectively formed on the both sides of the moving member 10, are connected, and the outlet paths 40*a* and 40*b*, which are respectively formed on the both sides of the moving member 10, are connected, so the paths are connected in parallel; in another embodiment, paths of a plurality of electromagnetic pumps may be serially connected. In this case, the outlet path 40*a* may be connected to the inlet path 38*b*, or the outlet path 40*b* may be connected to the inlet path 38*a*.

The invention claimed is:

1. A stator for an electromagnetic pump comprising:

a cylinder whose both end faces are respectively closed by a pair of frames;

a movable member having a magnetic body, in which flange sections are formed at both axial ends and outer circumferential faces of the flange sections act as magnetic flux working surfaces, said movable member being accommodated in said cylinder and capable of reciprocally moving in the axial direction thereof;

pump chambers being respectively formed between inner faces of the frames and both side faces of said movable member extended in the moving direction thereof; and air-core electromagnetic coils which are wound in opposite directions being fitted around a periphery of said cylinder, wherein yokes made of a magnetic material are provided to end faces of the electromagnetic coils to face the flange sections of the movable body;

an outer yoke encloses outer faces of the yokes;

a spacer made of a nonmagnetic material or an air space is provided between adjacent yokes, and wherein the movable member is repeatedly moved toward one of the sides according to a magnitude relation between magnetic attraction forces which work to the movable member and are generated by magnetic circuits formed between the flange sections and the adjacent yokes and between the flange sections, the end yoke, and the adjacent yokes when an electric current is supplied to the electromagnetic coils with the changing of the current direction, and wherein a restoring force for returning the movable member toward a center of a stroke is generated by magnetic circuits formed between the movable member and the adjacent yokes when the movable member is located on one of the sides and the electric current to the electromagnetic coils is turned off.

* * * * *